US005931392A

United States Patent [19]

Adams

[11] Patent Number: 5,931,392

[45] **Date of Patent: *Aug. 3, 1999**

[54] HIGH-PRESSURE CLEANING SPRAY NOZZLE

[76] Inventor: Robert J. Adams, 42 W. 927 Empire Rd., St. Charles, Ill. 60175

[ * ] Notice: This patent issued on a continued prosecution application filed under 37 CFR 1.53(d), and is subject to the twenty year patent term provisions of 35 U.S.C. 154(a)(2).

[21] Appl. No.: 08/813,116

[22] Filed: Mar. 7, 1997

[51] Int. Cl.[6] ..... B05B 1/04

[52] U.S. Cl. ..... 239/589; 239/590; 239/597

[58] Field of Search ..... 239/589, 590, 239/591, 592, 597, 601

[56] References Cited

U.S. PATENT DOCUMENTS

| | | | |
|---|---|---|---|
| 2,508,874 | 5/1950 | Turnbull | 239/591 |
| 2,701,412 | 2/1955 | Wahlin | 239/601 |
| 3,419,220 | 12/1968 | Goodwin et al. | 239/591 |
| 3,570,766 | 3/1971 | Johnson | 239/601 |
| 3,659,787 | 5/1972 | Ito | 239/601 |
| 4,635,856 | 1/1987 | Reed | 239/590 |
| 4,805,839 | 2/1989 | Malek | 239/601 |
| 4,878,785 | 11/1989 | Heron et al. | 239/590 |
| 5,575,409 | 11/1996 | Gruendeman | 239/600 |

*Primary Examiner*—Andres Kashnikow
*Assistant Examiner*—Lisa A. Douglas
*Attorney, Agent, or Firm*—Leydig, Voit & Mayer, Ltd.

[57] ABSTRACT

A high-pressure spray nozzle includes a nozzle body with a longitudinal channel formed therein that provides a fluid passageway between an inlet and a mouth zone. The passageway has an inner configuration that includes a shoulder with a generally radiused portion that enables increased force and a more even spray distribution for fluid exiting the mouth zone.

18 Claims, 2 Drawing Sheets

HIGH-PRESSURE CLEANING SPRAY NOZZLE

FIELD OF THE INVENTION

The present invention relates generally to spray nozzles, and more particularly, to spray nozzles for high-pressure cleaning applications.

BACKGROUND OF THE INVENTION

Spray nozzles for high-pressure cleaning applications typically direct a flat spray liquid discharge against a surface to be cleaned. The liquid discharge forcefully impinges against the surface in order to remove dirt or other particles thereon. If uniform cleaning is to take place, it is necessary that the liquid discharging spray have a substantially uniform impingement force for a given area. Heretofore, it has been difficult to achieve such uniformity in the force of the discharging spray particles due to turbulence created within the nozzle body at the required velocity of the liquid spray. Another aim in the development of such cleaning apparatus is to achieve a high cleaning effect with as little as possible consumption of cleaning fluid.

OBJECTS AND SUMMARY OF THE INVENTION

The general aim of the present invention is to provide a new and improved nozzle construction for use in high-pressure cleaning applications.

It is a further object of the present invention to provide a high-pressure spray nozzle with improved force of impingement of the discharging spray.

A more particular object of the invention is to achieve the foregoing through the provision of a nozzle construction having a particular inner surface configuration which reduces turbulence as the fluid is discharged from the nozzle.

It is an additional object of the invention to provide improved lateral spray stability in a high-pressure spray nozzle.

These and other objects and advantages are provided with a high-pressure spray nozzle having a particular structural arrangement which offers greater performance than known systems. The spray nozzle includes a nozzle body with a longitudinal channel formed therein. The channel defines a fluid passageway between an inlet end and an outlet or discharge orifice. The passageway gradually decreases from an upstream inlet toward an outlet zone and includes a shoulder with a generally radiused portion that transitions the passageway to an approach zone disposed proximate to the outlet zone. The approach has a reduced diameter and an increased length with respect to known nozzle designs. This configuration enables a greater force of impingement and a more even spray distribution for fluid discharged from the nozzle. Other objects and advantages will become more apparent from the following detailed description when taken in conjunction with the accompanying drawings.

DETAILED DESCRIPTION OF THE PREFERRED EMBODIMENTS

Generally, the present invention relates to a nozzle construction that provides improved impact spray distribution. The invention is intended for use in various high-pressure cleaning applications where a fluidized spray is to be impinged on a surface to be cleaned. Typically, the fluidized spray is water or other suitable cleaning solutions or fluids.

Figure 1:
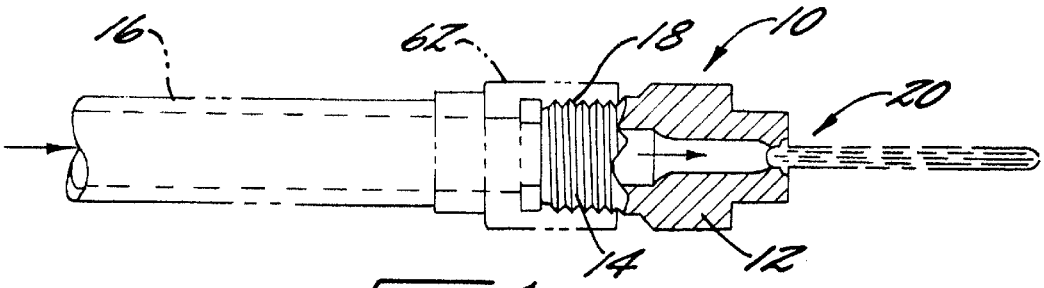
FIG. 1 is a partially cut-away view of a high-pressure cleaning nozzle which incorporates the features of the present invention.
Figure 2:
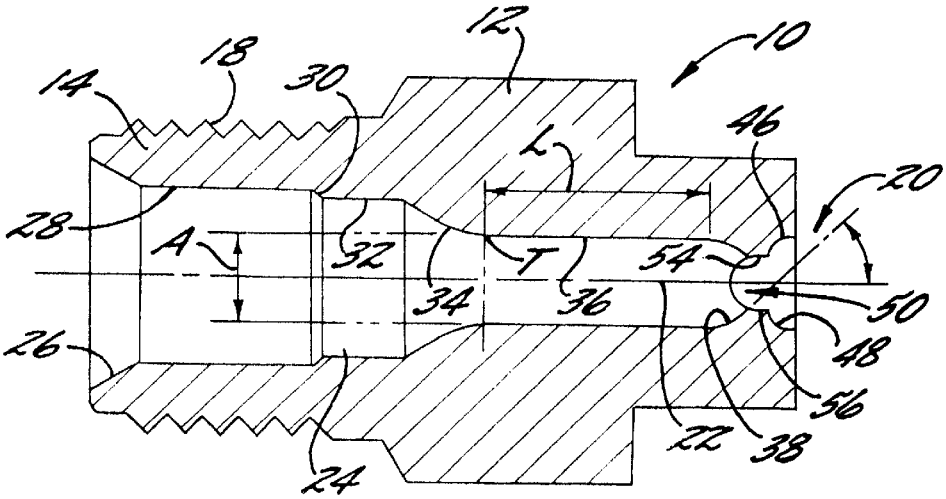
FIG. 2 is an enlarge cross-sectional view taken axially through the nozzle shown in FIG. 1.

FIGS. 1 and 2 illustrate a high pressure spray nozzle 10 embodying the present invention. The nozzle 10 is adapted for use in high-pressure cleaning apparatus for ejecting a high-pressure fan-shaped water jet toward a surface to be cleaned. The spray nozzle comprises a nozzle body 12 preferably constructed in one piece of metal or other suitable material. The nozzle body 12 includes an upstream end 14, which may be connected to a supply conduit 16 with the use of threads such as threads 18. A nozzle mouth zone 20 is located at the downstream end of the nozzle body. In the illustrated embodiment, the nozzle body 12 is substantially symmetrical in form about a longitudinal axis 22.

A channel or fluid passageway 24 is disposed through the nozzle body 12 and is formed as a longitudinally extending bore concentric to the nozzle body about the axis 22. The diameter of the channel 24 generally decreases toward the nozzle mouth zone 20 to define various channel sections. A conical entry zone 26 is located at the upstream entry zone of the nozzle body 12. The entry zone 26 leads to a first cylindrical section 28. A cylindrical second conical zone 30 couples the first cylindrical section 28 with a second cylindrical section 32 of smaller diameter than the upstream or first cylindrical section 28.

In accordance with one aspect of the invention, the inner channel configuration includes a radiused transition from the increased cylindrical sections to an approach section to provide greater performance characteristics. In the described embodiment, a curved throat section 34 couples the second cylindrical section 32 with an approach section 36. The approach section or zone 36, in turn, terminates at the nozzle mouth zone 20. The throat section 34 comprises a rounded or radiused shoulder which gradually narrows toward the approach section 36 and in so doing presents a smooth transition surface configuration between the second cylindrical section 32 and the approach section 36. The approach section 36 provides a generally cylindrical zone with a selected diameter A which defines a wall that extends a length L as shown in FIG. 2.

For effecting reduced turbulent flow within the nozzle, the shoulder defined by the throat section 34 preferably intersects the approach zone wall at a transition that is tangent to the radius of the shoulder 34 such as a transition point T shown in FIG. 2. This provides a smoothed transition fluid path and reduces turbulent flow within the channel. In the described embodiment, the ratio of the diameter A of the approach section 36 compared to the radius of the shoulder 34 is selected to be from between about 0.23 to 0.25.

In accordance with one advantage of the invention, the ratio of the approach diameter with respect to the approach length is chosen to provide increased fluid velocity. That is, the approach zone has a reduced diameter A that is utilized in conjunction with an increased approach zone length L as compared to known designs. For example, the channel section length L is chosen to be between approximately one and one-half to twice the diameter A of the approach zone. In the illustrated embodiment, the ratio of the approach length L is twice the approach diameter. The slightly reduced or descaled diameter A as compared to the approach length L provides an increased fluid velocity. This structure increases the fluid velocity and also stabilizes the resulting spray. For an exemplary spray nozzle having a 15° spray angle and a spray capacity of 0.4 gallons at 40 p.s.i., an approach zone with a 0.063 inches diameter may be employed rather than conventional spray nozzles that employ an approach diameter of 0.076 inches.

The distal end of the approach zone 36 includes an approach orifice 38 which forms a portion of a circular arc. The angle α of the approach orifice 38 with respect to the central axis 22 is preferably between 40 and 48 degrees. The ratio of the approach diameter A with respect to the radius of the approach orifice 38 is chosen to be about 1.5 for the exemplary spray nozzle described above.

Figure 3:
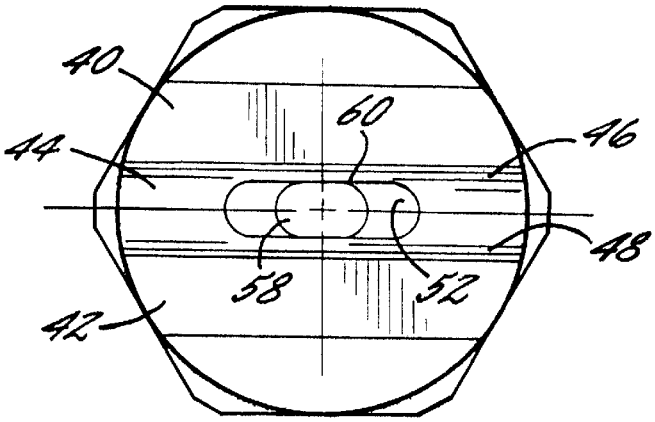
FIG. 3 is an end view of the nozzle shown in FIG. 2.

The nozzle mouth zone 20 is shown in detail in FIGS. 2 and 3. The mouth zone 20 is formed by a pair of ribs 40, 42 disposed in spaced parallel relation to one another and disposed at the distal end of the nozzle body 12. A groove 44 is disposed transversely through the nozzle body 12 and is arranged at a right angle with respect to the longitudinal central axis 22. The groove has rounded side walls 46, 48 which in each case follow a portion of a circular arc. An outwardly opening groove-type depression 50 is disposed centrally within the groove 44. The depression 50 which has a base 52 (see FIG. 3) rounded at its ends and defines a plane-constructed groove walls 54, 56. The groove walls 54, 56 are arranged lying opposite one another in spaced parallel relation.

The depression 50 intersects the longitudinally extending channel 24 in the zone of the rounded approach orifice wall 38. This arrangement forms a passage 58 bounded by an edge 60 (see FIG. 3). The edge 60 is continuously curved and in plan view resembles an ellipse. It is defined by the section of a semi-cylindrical base 52 of the depression 50 with the curved wall 38 of the approach orifice.

Figure 4:
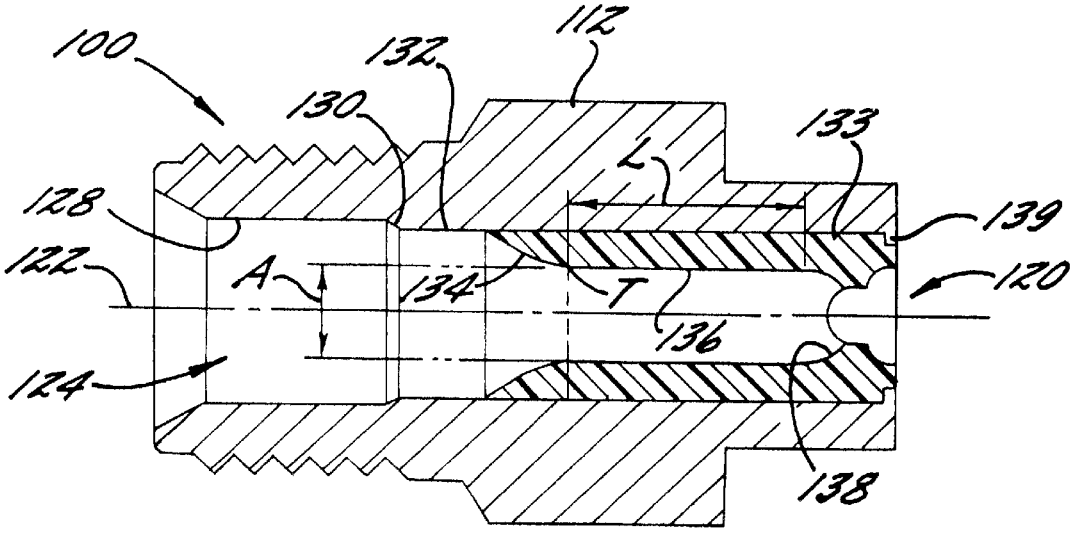
FIG. 4 is a cross-sectional view taken axially through a high-pressure cleaning nozzle according to another embodiment of the present invention.

In one preferred implementation of the invention, the nozzle is fabricated as a unitary piece from hardened stainless steel. Alternatively, the nozzle may be fabricated as two or more pieces that are designed to be mated or press-fit together such as the embodiment shown in FIG. 4. As shown there, a high-pressure spray nozzle 100 includes a nozzle body 112 formed with a longitudinally extending bore concentric to a central axis 122 to present a channel 124. In this embodiment, the channel 124 is formed with first cylindrical section 128 and a second cylindrical section 132 which substantially extends the from a conical zone 130 to the distal end of the nozzle body 112. The cylindrical section 130 forms a cylindrical opening sized to receive an annular insert 133. The inner surface configuration of the insert 133 includes a radiused shoulder 134, an approach section 136, as well as an approach orifice 138 and other components of the nozzle mouth zone 120 as described above in connection with FIGS. 1–3. The size, dimensions, and relative placement of the shoulder 134 and approach section 136 are also the same as described above in connection with FIGS. 1–3.

In the illustrated embodiment, the insert 133 may be held in place within the opening 130 with the use of a flange 139 disposed at the end of the nozzle body 112. By way of example, the insert may be fabricated of tungsten carbide or a suitable ceramic material. This has particular use when the nozzle is intended to spray abrasive liquids or the like.

For effecting coupling of the spray nozzle with the supply conduit, the inlet end is coupled with a conventional female coupling 62 disposed at the end of the supply conduit 16. Alternatively, a quick disconnect configuration may be readily utilized as will be understood by those skilled in the art.

In operation, fluid is directed through the supply conduit 16 and toward the upstream end 14 in the direction denoted by the arrow in FIG. 1. Inasmuch as the approach diameter is reduced, the fluid velocity through the nozzle is increased. The increased length of the approach stabilizes the spray. In addition, the radiused shoulder 34 and transition with the approach zone reduces turbulence as the fluid enters the approach zone 36. The resulting spray pattern is a relatively flat fan spray pattern. In the case of water consumption and water pressure remaining constant, the jet force is increased by one-half with respect to conventional flat-jet nozzles. The resulting cleaning effect is substantially improved by 130 to 200 percent or more in comparison with conventional nozzles over the range of flow rates and spray angles typically utilized in high-pressure washing or cleaning applications.

For providing added stabilization to the liquid passing through the fluid passageway 24, a guide vane or flow stabilizer (not shown) may be utilized in conjunction with the invention as will be understood by one skilled in the art to which this invention pertains. Typically, such a flow stabilizer is provided as a piece of sheet metal formed in the shape of a "FIG. 8" or a cross when viewed from the upstream end of the nozzle. The stabilizer may be located within the cylindrical section 28 and substantially extend the length thereof in abutment against the conical zone 30.

Various advantages in the resulting spray pattern are achieved with the invention. For example, where prior spray nozzles may provide a relatively uneven spray pattern with the tendency for streaking or the like to be observed on the cleaning surface, the present invention provides a consistent spray pattern to the surface. That is, the impact force of impingement applied to the surface is flattened out across the entire surface due to the increased approach length for a given flow. The reduced approach diameter for a given flow also provides increased velocity of the fluid for a particular flow rate utilized.

Accordingly, a high pressure spray nozzle meeting the aforestated objectives has been described. While the invention is susceptible of various modifications and alternative constructions, certain illustrated embodiments hereof have been shown in the drawings and will be described in more detail. It should be understood, however, that there is not an intention to limit the invention to the specific forms disclosed, but on the contrary, the intention is to cover all modifications, alternative constructions and equivalents found within the spirit and scope of the invention.

What is claimed is:

1. A high-pressure liquid spray cleaning system comprising:

a high pressure liquid supply, a spray nozzle connected to said high pressure liquid supply, said spray nozzle comprising an elongate one-piece nozzle body having an upstream inlet end through which a liquid may be directed into the body and an outlet end;

said nozzle body having a longitudinal continuously converging liquid flow passageway extending between the inlet end and the outlet end, said longitudinal passageway including a first annular passageway having a first diameter, a second annular passageway disposed downstream from the first annular passageway, a third annular approach passageway having a diameter less than that of the first and second passageways, and a radiused shoulder defining a curved transition between the second passageway and the third passageway; and said longitudinal flow passageway having a discharge orifice at the outlet end of said body smaller in size than the third passageway for imparting a predetermined flat spray pattern to liquid discharging from said nozzle.

2. The invention as in claim 1 including a radiused approach joining the third passageway with the discharge orifice.

3. The invention as in claim 2 wherein the length of the third approach passageway is between one and one-half to twice the diameter of the third approach passageway.

4. The invention as in claim 3 wherein said shoulder defines a radius that intersects the third approach passageway at a point of tangency.

5. The invention as in claim 1 wherein the ratio of the diameter of the third approach passageway with the radius of the shoulder is between about 0.23 to 0.25.

6. A high-pressure liquid spray cleaning system comprising:

a high pressure liquid supply, a spray nozzle connected to said high pressure liquid supply, said spray nozzle comprising an elongate one-piece hollow nozzle body having an upstream inlet end through which a liquid may be directed into the body and an outlet end;

said nozzle body having a liquid flow passageway extending between the inlet end and the outlet end concentric about a longitudinal axis, said liquid flow passageway including a first annular section having a first diameter, a second annular section disposed downstream from the first annular section and having a diameter less than that of the first passageway, a third annular approach section disposed between the second annular passageway and the outlet end providing an approach passageway of a selected approach diameter along an approach length, and a curved shoulder connecting the second annular section with the approach section wherein the ratio between the diameter of the approach section and the approach length is about 0.23 to 0.25;

said liquid flow passageway having a discharge orifice downstream from said approach section sized smaller than the diameter of the third annular section for imparting a predetermined flat spray pattern to liquid passing through said chamber and discharging from said nozzle; and a connection arrangement disposed proximate the inlet end for coupling the nozzle body with a supply conduit.

7. The invention as in claim 6 wherein the length of the third annular approach section is between one and one-half and twice the diameter of the third annular approach section.

8. The invention as in claim 7 wherein the length of the third annular approach section is about twice the diameter of the third annular approach section.

9. The invention as in claim 8 wherein the curve of the shoulder defines a radius that intersects the third annular approach section to define a smooth transition.

10. The invention as in claim 9 wherein the radius meets the third annular approach section at a point of tangency to the radius.

11. The invention as in claim 6 wherein the ratio of the diameter of the third annular approach section with the radius of the shoulder is between about 0.23 to 0.25.

12. A high-pressure liquid spray cleaning system comprising:

a high pressure liquid supply, a spray nozzle connected to said high pressure liquid supply, said spray nozzle comprising a one-piece elongated nozzle body having an upstream inlet end through which a liquid may be directed into the body and an outlet end;

a continuously converging longitudinal liquid flow passageway disposed in said nozzle body extending between the inlet end and the outlet end, said longitudinal passageway including a first passageway having a first diameter, a second approach passageway that extends a selected length and defines an approach diameter less than that of the first passageway, and a shoulder defining a curved transition between the first passageway and the second passageway; and said liquid flow passageway having a discharge orifice the outlet end of said body sized less than the diameter of said second passageway for imparting a predetermined flat spray pattern to liquid passing through said longitudinal end discharging from said nozzle.

13. The invention as in claim 12 wherein said flow passageway is defined at least in part by an insert disposed within said body.

14. The invention as in claim 12 further comprising a third annular passageway, disposed upstream from second the approach passageway and providing a fluid communication path between the first passageway and the inlet.

15. The invention as in claim 14 wherein said flow passageway includes a radiused approach joining the second approach passageway with the discharge orifice.

16. The invention as in claim 15 wherein the length of the second approach passageway is between one and one-half to twice the diameter of the second approach passageway.

17. The invention as in claim 16 wherein the shoulder defines a radius that intersects the second approach passageway at a point of tangency.

18. The invention as in claim 17 wherein the ratio of the diameter of the second approach passageway with the radius of the shoulder is between about 0.23 to 0.25.

* * * * *